US008256610B2

(12) United States Patent
Michas et al.

(10) Patent No.: US 8,256,610 B2
(45) Date of Patent: Sep. 4, 2012

(54) GOLF BAG WITH A CARRYING SYSTEM, A LOCKABLE STAND SYSTEM, AND A RECESSED STAND SYSTEM

(75) Inventors: Luke Michas, Niceville, FL (US); Christopher Piedra, West Miami, FL (US)

(73) Assignee: Dynamic Brands, LLC, Richmond, VA (US)

( * ) Notice: Subject to any disclaimer, the term of this patent is extended or adjusted under 35 U.S.C. 154(b) by 1192 days.

(21) Appl. No.: 11/511,776

(22) Filed: Aug. 29, 2006

(65) Prior Publication Data

US 2008/0054318 A1 Mar. 6, 2008

(51) Int. Cl.
*A63B 55/06* (2006.01)
*A63B 55/10* (2006.01)

(52) U.S. Cl. ..... 206/315.7; 206/315.3; 248/96

(58) Field of Classification Search ..... 206/315.2, 206/315.7, 315.3; 248/96, 95, 97
See application file for complete search history.

(56) References Cited

U.S. PATENT DOCUMENTS 1,181,007 A * 4/1916 Huber ..... 248/96
1,686,774 A * 10/1928 Sperry ..... 248/96
1,727,612 A * 9/1929 Wright ..... 248/96
1,738,242 A * 12/1929 Gunther ..... 248/96
1,882,785 A * 10/1932 Doughty ..... 248/96
1,924,182 A * 8/1933 Fritz ..... 248/96
1,961,454 A * 6/1934 Reichhart ..... 248/96
1,978,230 A * 10/1934 Sehutes ..... 248/96
2,282,842 A * 5/1942 Abell ..... 248/96
2,283,412 A * 5/1942 Bright ..... 206/315.5
2,846,170 A * 8/1958 Huber ..... 248/96
5,038,984 A 8/1991 Izzo
5,042,703 A 8/1991 Izzo
5,042,704 A 8/1991 Izzo
5,147,089 A * 9/1992 Anderson ..... 248/96
5,415,285 A 5/1995 Reimers
5,507,384 A 4/1996 Maeng
5,549,263 A 8/1996 Maeng
5,558,259 A 9/1996 Izzo
5,593,077 A 1/1997 Izzo
5,662,296 A 9/1997 Wu
5,673,879 A 10/1997 Hsieh
5,678,791 A * 10/1997 Maeng ..... 248/96
5,681,016 A 10/1997 Wang
5,762,189 A 6/1998 Reimers
5,996,789 A 12/1999 Suggs et al.
6,006,974 A 12/1999 Varney et al.
6,098,797 A 8/2000 Han
6,164,606 A 12/2000 Sundara et al.
6,168,123 B1 1/2001 Stein et al.
6,220,433 B1 * 4/2001 Kang ..... 206/315.7
6,241,201 B1 * 6/2001 Wang ..... 248/96
6,253,913 B1 * 7/2001 Suk ..... 206/315.5
6,296,116 B1 10/2001 Schmidt et al.
6,315,117 B1 11/2001 Han
6,427,954 B1 8/2002 Sundara et al.

(Continued)

*Primary Examiner* — Sue Weaver
(74) *Attorney, Agent, or Firm* — Matthew C. Osborne, Esq.; Troutman Sanders LLP

(57) ABSTRACT

A golf bag is provided including a carrying system having two members attached to a surface of the golf bag and arranged to form an "X" pattern. A casing is affixed to the golf bag and defines a recess in a surface of the golf bag. A stand system is mounted in the recess. The stand system includes a pair of attached pivotal members and a center rod assembly disposed between the pivotal members. The stand system further includes a spring mounted to an upper end of the center rod assembly, whereby compression and release of the spring cause the pivotal members to pivot between extended and retracted positions.

19 Claims, 13 Drawing Sheets

U.S. PATENT DOCUMENTS

| | | | | |
|---|---|---|---|---|
| 6,457,620 | B1 | 10/2002 | Batten et al. | |
| 6,460,747 | B1 | 10/2002 | Tuerschmann et al. | |
| 6,481,674 | B1 * | 11/2002 | Lin | 248/96 |
| 6,669,069 | B2 | 12/2003 | Suggs | |
| 6,698,696 | B1 * | 3/2004 | Yang | 248/96 |
| 6,726,157 | B2 * | 4/2004 | Yoon | 248/97 |
| 6,926,183 | B2 | 8/2005 | Chang | |
| 7,017,869 | B2 * | 3/2006 | Wang | 248/96 |
| 7,025,237 | B2 | 4/2006 | Herold | |
| 2002/0134894 | A1 * | 9/2002 | Wang | 248/96 |
| 2003/0102234 | A1 * | 6/2003 | Lin | 206/315.7 |
| 2006/0196791 | A1 * | 9/2006 | Evans et al. | 206/315.1 |
| 2007/0068829 | A1 * | 3/2007 | Watanabe | 206/315.7 |
| 2008/0135431 | A1 * | 6/2008 | Tan | 206/315.7 |

* cited by examiner

GOLF BAG WITH A CARRYING SYSTEM, A LOCKABLE STAND SYSTEM, AND A RECESSED STAND SYSTEM

FIELD OF INVENTION

The present invention relates generally to golf bags. More particularly, it relates to improved golf bag components. Most particularly, it relates to golf bag carrying systems, stand systems, and a stand storage structure.

BACKGROUND

In a dual-strap golf bag carrying system, two shoulder straps are attached to a golf bag, usually at the middle and top portions of the golf bag. A bag carrier's arms are inserted into the shoulder loops and the weight of the golf bag is shared between the shoulders. Human shoulders typically have a downward slope. As such, the heavier the contents of a golf bag utilizing a conventional dual-strap carrying system, the more readily the straps will slide off the user's shoulders. Accordingly, there remains a need for a dual-strap carrying system with superior fit and increased comfort that does not slide off the user's shoulders. Furthermore, there also remains a need for a dual-strap carrying system that can also function exceedingly well as a single-strap carrying system for carrying a golf bag short distances or as a player approaches his or her ball.

Conventional golf bag stand systems may include bent wires or the like that act as springs for extending and retracting stand system legs. Generally, the force of setting the golf bag on the ground pushes upward on a pair of bent wire spring members which act to force the legs outward. A variety of problems are caused by the fact that bent wire forms are not always identically produced. For example, imprecise bent wires result in unpredictable stand system actuation, i.e., the legs open at different widths with respect to each other. Furthermore, most conventional bent wires require a tensioning device to control the amount of spring force applied to the leg pivots. This spring force pulls the extended legs toward the center of the bag and frequently causes the legs to impact the bent wires or actuator components making an undesirable clicking noise.

Additional disadvantages of such a conventional stand system include the possibility of two legs crossing into an "X" when retracted due to imprecise bent wires or one or both of the legs getting caught behind the bent wires and preventing leg extension. Accordingly, there remains a need for an improved stand system that provides easy and reliable extension and retraction of the system's legs.

Golf bags are typically of the stand-type (as briefly described above) for walkers, and of the cart-type for riders. Cart-type golf bags typically do not include a stand system and are designed to hold all of a golfer's gear, in addition to golf clubs, since the bag will be transported on a golf cart and weight is not a concern. They frequently do not independently stand safely upright in a terrain typically found on a golf course (e.g., uneven ground, hills, etc.). Stand-type golf bags include a stand system (as briefly described above) and are designed to be carried by a golfer or caddy. Accordingly, stand-type golf bags are typically designed to be lighter than cart-type golf bags.

Some golfers may walk during one golf game and ride a cart during another. Accordingly, the different types of golf bags (stand versus cart) can make such variations in play cumbersome. Alternatively, a golfer may be compelled to own two styles of bags (one stand-style and one cart-style) and switch between them. A golfer who owns only one style of golf bag will be forced to awkwardly use the bag in a manner inconsistent with the design of the bag, i.e., carrying a cart-type golf bag or transporting a stand-type golf bag via a golf cart. A disadvantage of carrying a cart-type golf bag is that it will not likely independently stand safely upright and, therefore, it must be laid down. This makes it awkward for the golfer to retrieve and return clubs and, of course, increases the likelihood that the golf bag will get dirty and/or wet. A disadvantage of transporting a stand-type golf bag via a golf cart is that the stand system protrudes from the profile of the golf bag and interferes with other components (e.g., the metal bracket of a motorized golf cart or cart straps) transported on the golf cart. Furthermore, typical damage to a protruding stand system due to repeated use on a motorized golf cart includes bent wire assemblies affecting stand actuation, bent or broken legs, and/or broken leg brackets.

Accordingly, there remains a need for a hybrid golf bag that will independently stand upright and will not interfere with other components on a golf cart.

SUMMARY

The present invention provides a golf bag including a carrying system having two members attached to a surface of the golf bag and arranged to form an "X" pattern. A casing is affixed to the golf bag and defines a recess in a surface of the golf bag. A stand system is mounted in the recess. The stand system includes a pair of attached pivotal members and a center rod assembly disposed between the pivotal members. The stand system further includes a spring mounted to an upper end of the center rod assembly, whereby compression and release of the spring cause the pivotal members to pivot between extended and retracted positions.

The present invention also provides a dual-strap carrying system for use with a golf bag exerting a downward force on the dual-strap carrying system and having an open end, a mid-section, and a closed end. The dual-strap carrying system includes a segmented left-shoulder strap and a segmented right-shoulder strap, each of open loop configuration and extending in a generally longitudinal direction between spaced attachment points along the golf bag. The dual-strap carrying system further includes a left-side back member and a right-side back member pivotally connected to each other by a center pivot point device.

The present invention further provides a stand system for use with a golf bag having an open end and a closed end. The stand system includes a ground engaging member pivotally attached adjacent the closed end of the golf bag. A pair of pivotal members is attached adjacent the open end of the golf bag. A center rod assembly is disposed between the pivotal members. A spring is disposed at an upper portion of the center rod assembly. A tilting of the golf bag toward the ground engaging member causes an upward ground force to be exerted upon the ground engaging member and translated to an upward force upon the center rod assembly, thereby compressing the spring and causing the pivotal members to pivot in an outward direction away from the golf bag to an extended position. A tilting of the golf bag from the extended position away from the ground engaging member causes the upward ground force to be removed from the ground engaging member and the center rod assembly, thereby permitting the spring to expand and causing the pivotal members to pivot in an inward direction toward the golf bag to a retracted position.

The present invention also provides a casing for use with a golf bag. The casing includes a shell affixed to an outer surface of the golf bag. The shell defines a recess that houses a stand system in a recessed configuration.

The present invention further provides a golf bag including a frame defining top, bottom, and sides of the golf bag with a covering connected to and overlying the frame. At least two carrying members having at least four ends are attached to the frame at spaced apart locations so that the carrying members are arranged in a crossing pattern. A casing is affixed to the frame and defines a recess in a surface of the covering. The golf bag further includes a bag stand having at least two pivotal members, having fixed and free ends, mounted with the fixed ends adjacent to the top of the frame. A rod is located between the pivotal members and extends between the top and bottom of the frame. A connecting linkage connects the two pivotal members and the rod. An elastic element is operatively associated with the pivotal members and the connecting linkage. Actuation of the elastic element causes the pivotal members to move away from and toward the recess in the casing.

DETAILED DESCRIPTION OF THE PREFERRED EMBODIMENT(S)

Figure 1:
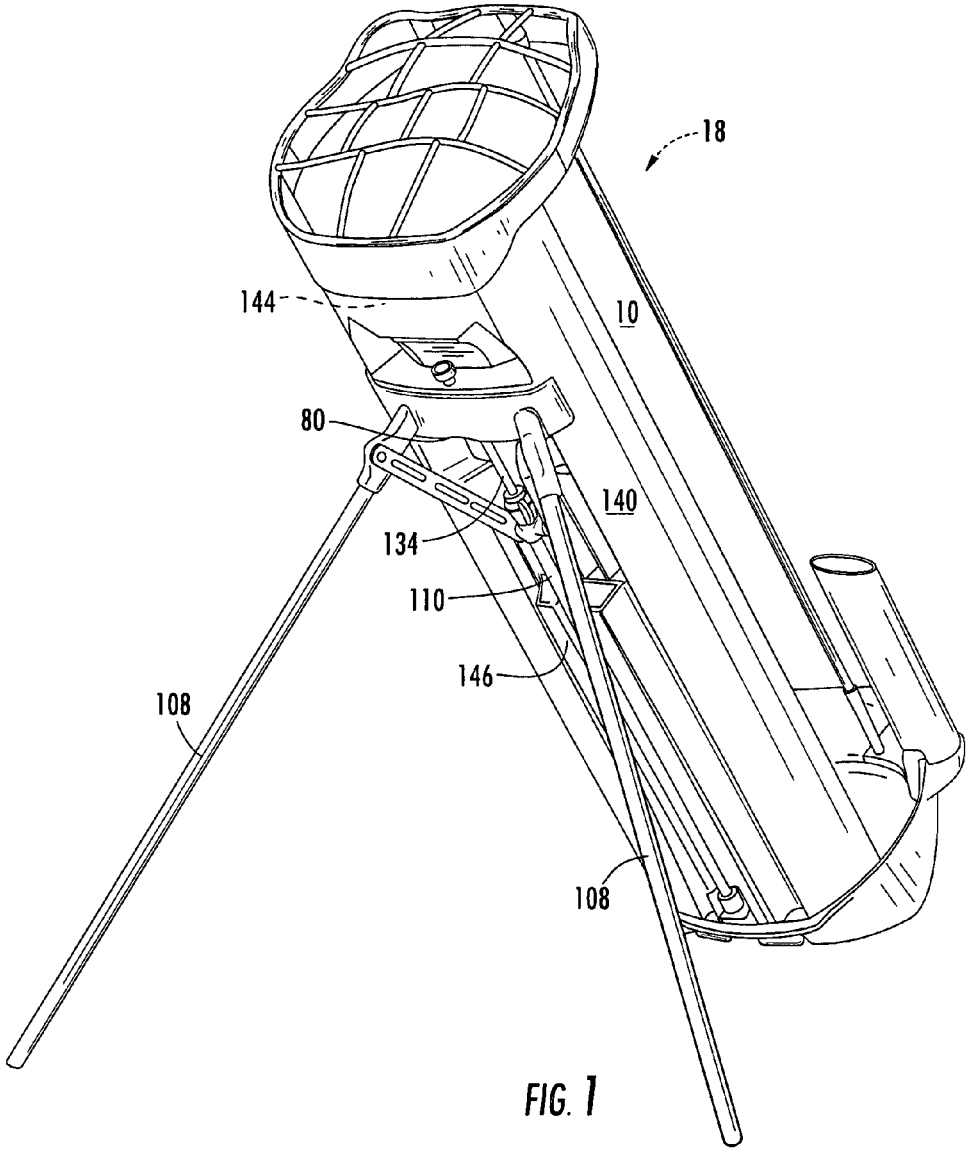
FIG. 1 is a perspective view of a golf bag structure for a carrying system and a recessed stand in accordance with the present invention.

Certain terminology is used in the following description for convenience only and is not considered limiting. Words such as "front," "back," "top," and "bottom" designate directions in the drawings to which reference is made. This terminology includes the words specifically noted above, derivatives thereof, and words of similar import. Additionally, the terms "a" and "one" are defined as including one or more of the referenced item unless specifically noted. The phrase "at least one" followed by a list of two or more items, such as A, B, or C, means any individual one of A, B, or C, as well as any combination thereof.

The preferred embodiments of the present invention are described below with reference to the drawing figures where like numerals represent like elements throughout.

Referring to FIG. 1, a golf bag 10 includes a carrying system 20 having two members 26, 28 attached to a surface 18 of the golf bag 10 and arranged to form an "X" pattern. A casing 140 is affixed to the golf bag 10 and defines a recess 146 in a surface 144 of the golf bag 10. A stand system 80 is mounted in the recess 146. The stand system 80 includes a pair of attached pivotal members 108 and a center rod assembly 110 disposed between the pivotal members 108. The stand system 80 further includes a spring 134 mounted to an upper end of the center rod assembly 110, whereby compression and release of the spring 134 cause the pivotal members 108 to pivot between extended and retracted positions.

Figure 2:
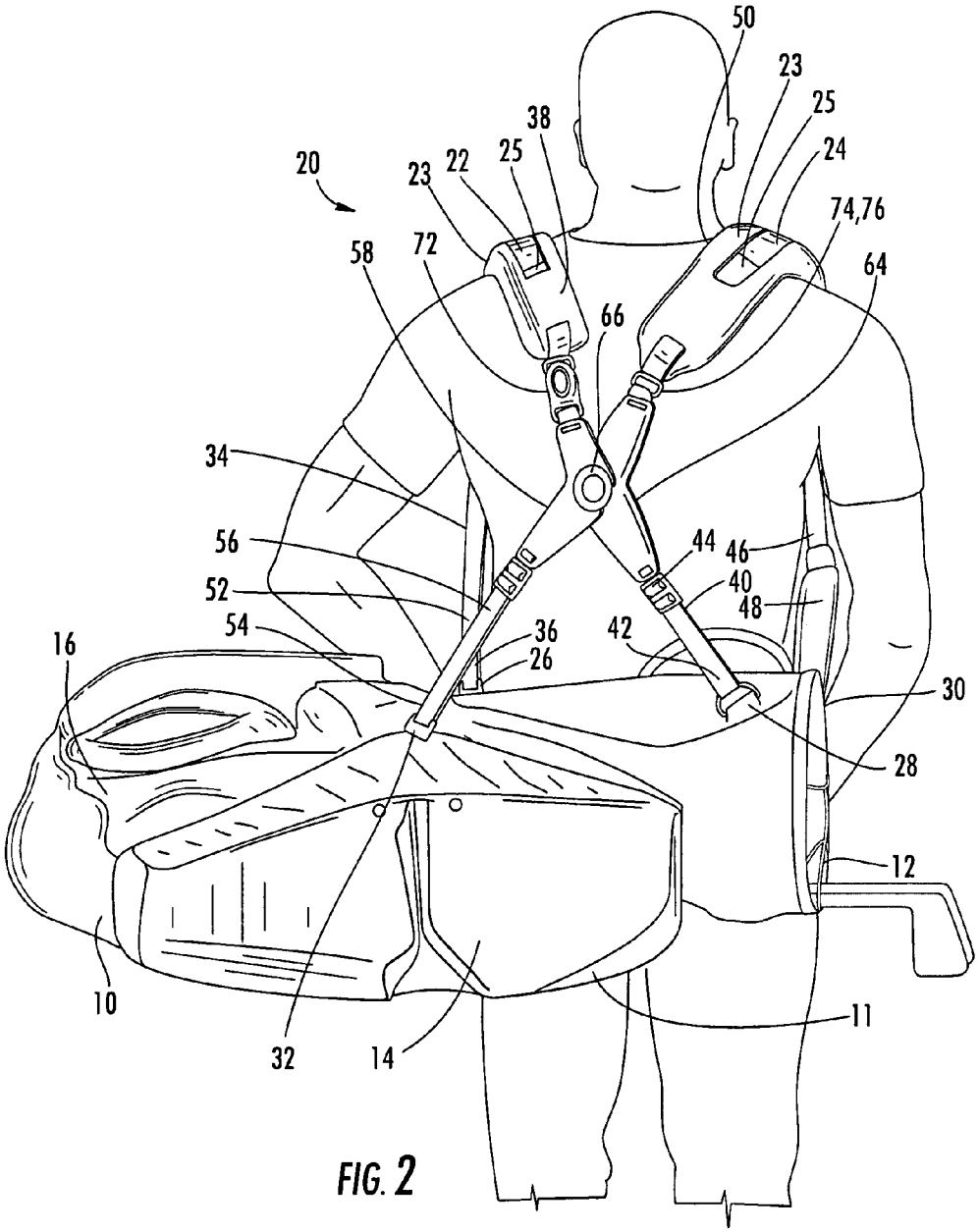
FIG. 2 is a rear view of a carrying system for use with a golf bag in accordance with the present invention.
Figure 3:
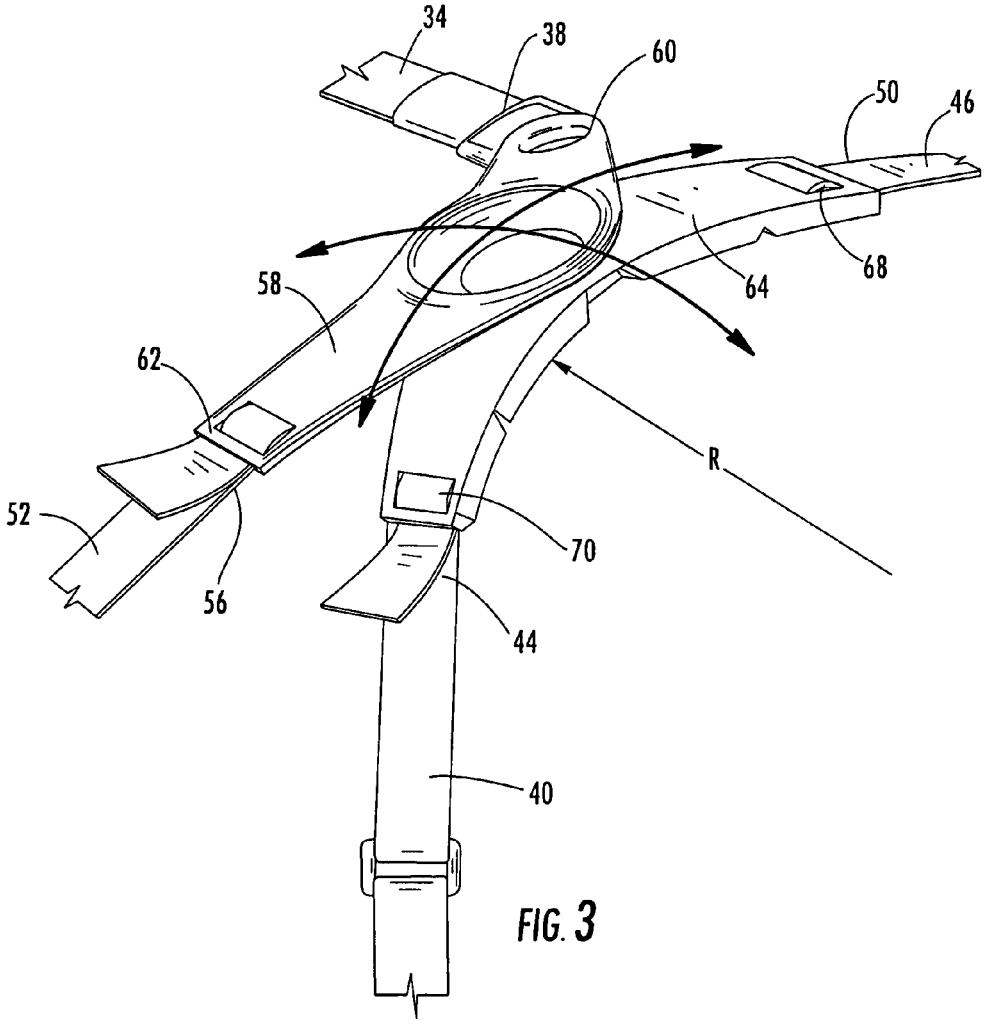
FIG. 3 is a perspective view of two members of the carrying system of FIG. 2 pivotally positioned with respect to each other in an "X" pattern.

FIGS. 2 and 3 illustrate a dual-strap carrying system 20 for use with a golf bag 10 exerting a downward force on the dual-strap carrying system 20. Referring to FIG. 2, the golf bag 10 has an open end 12, a mid-section 14, and a closed end 16. The dual-strap carrying system 20 includes a segmented left-shoulder strap 22 and a segmented-right shoulder strap 24, each of open loop configuration extending in a generally longitudinal direction between spaced attachment points 26, 28, 30, 32 along the golf bag 10.

The segmented left-shoulder strap 22 includes a forward strap segment 34 having a forward end 36 attached at a forward attachment point 26 disposed substantially along the mid-section 14 of the golf bag 10. The forward strap segment 34 further includes a rearward end 38. The segmented left-shoulder strap 22 further includes a rearward strap segment 52 having a rearward end 54 attached at a rearward attachment point 32 disposed substantially along the mid-section 14 of the golf bag 10. The rearward strap segment 52 further includes a forward end 56.

The segmented right-shoulder strap 24 includes a forward strap segment 46 having a forward end 48 attached at a forward attachment point 30 disposed substantially adjacent the open end 12 of the golf bag 10. The forward strap segment 46 further includes a rearward end 50. The segmented right-shoulder strap 24 further includes a rearward strap segment 40 having a rearward end 42 attached at a rearward attachment point 28 disposed substantially adjacent the open end 12 of the golf bag 10. The rearward strap segment 40 further includes a forward end 44.

The dual-strap carrying system 20 further includes a left-side back member 58 having a forward end 60 and a rearward end 62. Referring to FIG. 3, the forward end 60 is attached to the rearward end 38 of the forward strap segment 34 of the segmented left-shoulder strap 22. The rearward end 62 is attached to the forward end 56 of the rearward strap segment 52 of the segmented left-shoulder strap 22. A right-side back member 64 is pivotally connected to the left-side back member 58 by a center pivot point device 66 (shown in FIG. 2). The right-side back member 64 includes a forward end 68 and a rearward end 70. The forward end 68 is attached to the rearward end 50 of the forward strap segment 46 of the segmented right-shoulder strap 24. The rearward end 70 is attached to the forward end 44 of the rearward strap segment 40 of the segmented right-shoulder strap 24.

The downward force exerted by the golf bag 10 on the dual-strap carrying system 20 is increased as heavier contents are added to the golf bag 10 and/or as user activity produces dynamic loads. Such an increase in the downward force causes each rearward end 62, 70 of the left-side back member 58 and the right-side back member 64 to rotate in an outwardly direction with respect to each other. The left-side back member 58 and the right-side back member 64 pivot in a reverse scissor motion. Accordingly, rotation of each rearward end 62, 70 of the left-side back member 58 and the right-side back member 64 in an outwardly direction with respect to each other causes each forward end 60, 68 of the left-side back member 58 and the right-side back member 64 to rotate in an inward direction with respect to each other. Such movement causes each forward strap segment 34, 46 of the segmented left-shoulder strap 22 and the right-shoulder strap 24 to move toward each other, helping to prevent the straps 22, 24 from sliding off the user's shoulders.

The dual-strap carrying system 20 can be converted for single-strap use over either shoulder as desired. Pivotal attachment between either one of the left-side or right-side back members 58, 64 and its respective forward strap segment 34, 46 helps facilitate such single-strap use. FIG. 2 illustrates, for example, a shoulder pivot point device 72 pivotally attaching the forward end 60 of the left-side back member 58 to the rearward end 38 of the forward strap segment 34 of the segmented left-shoulder strap 22. Such a shoulder pivot point device 72 could alternatively pivotally attach the forward end 68 of the right-side back member 64 to the rearward end 50 of the forward strap segment 46 of the segmented right-shoulder strap 24 (not shown), if desired. The shoulder pivot point device 72 may be integrated into the rearward end 38 of the forward strap segment 34 of one of the segmented left-shoulder strap 22 and the right-shoulder strap 24, as shown in FIG. 2. Alternatively, the shoulder pivot point device 72 may be integrated into one of the forward ends 60, 68 of the left-side back member 58 and the right-side back member 64, as shown in FIG. 3. The shoulder pivot point device 72 allows the strap to which it is connected to fall away from the user's shoulder during single-strap use of the carrying system 20. Such a feature, in conjunction with the center pivot point 66 of the left-side and right-side back members 58, 64, transfers the load on the strap not in use to the strap that is in use. In other words, the system functions exceedingly well as a single-strap carrying system for carrying a golf bag short distances or as a player approaches his or her ball.

Each of the attachments of the rearward ends 62, 70 of the left-side back member 58 and the right-side back member 64 to the forward end 56, 44 of the rearward strap segment 52, 40 of the respective segmented left-shoulder strap 22 and segmented right-shoulder strap 24 is adjustable. Such adjustability helps to achieve a superior fit and increased comfort for the user. Alternatively, each of the attachments of the forward ends 60, 68 of the left-side back member 58 and the right-side back member 64 to the rearward end 38, 50 of the forward strap segment 34, 46 of the respective segmented left-shoulder strap 22 and segmented right-shoulder strap 24 may be adjustable, and/or the golf bag attachment points 26, 28, 30, 32 may be adjustable.

The center pivot point device 66 includes at least one stop to limit the rotation of the left-side back member 58 and the right-side back member 64 with respect to each other. Furthermore, the center pivot point device 66 is releasable for ease of assembly. As illustrated in FIG. 3, each of the left-side back member 58 and the right-side back member 64 extends radially from its respective forward end 60, 68 and rearward end 62, 70 through a curvature radius R of about 25 to 35 inches. Such a range results in a comfortable configuration for the average user, but may be modified as necessary to accommodate specific user sizes.

Each of the left-side back member 58 and the right-side back member 64 is molded from plastic material. The present invention, however, is not limited to such material, and each of the left-side back member 58 and the right-side back member 64 may be molded or machined from composite material or any other material rigid enough to perform the above-stated functions. Each of the left-side back member 58 and the right-side back member 64 is covered with padding 74 and fabric 76, as illustrated in FIG. 2.

Each of the forward strap segments 34, 46 of the left-shoulder strap 22 and the right-shoulder strap 24 includes at least one pocket 23 containing beads 25 made from expanded polystyrene plastic, as illustrated in FIG. 2. The beads 25 (also referred to as microbeads due to their extremely small size) contained within the pockets 23 on the forward strap segments 34, 46 conform the straps 22, 24 to the user's shoulders and distribute weight, offering cushion and comfort for a completely custom fit. The material contained within the pockets 23 is not limited to expanded polystyrene plastic microbeads, and the pockets 23 may contain other plastics, composite material, foam, gel, or any other material in various forms supple enough to perform the above-stated functions.

The dual-strap carrying system 20 is stowable (not shown) within a pocket 11 (shown in FIG. 2) formed on a surface of the golf bag 10. Such a feature allows the user to easily stow away the carrying system 20 within the pocket 11 during cart use for a streamlined appearance. Stowing the dual-strap carrying system 20 also prevents it from interfering with other components (e.g., the metal bracket of a motorized golf cart or cart straps) transported on the golf cart.

Referring to FIGS. 4-9B, a stand system 80 is provided for use with the golf bag 10. The stand system 80 includes a base member 82 encasing the closed end 16 of the golf bag 10. A cylindrically-shaped vertical constraint 84 is integrally molded at a top portion of the base member 82. A ground engaging member 86 is pivotally attached adjacent the closed end 16 of the golf bag 10. More specifically, the ground engaging member 86 is pivotally attached at one end to a bottom portion of the base member 82, and the stand system 80 further includes a link 88 pivotally connected at one end to another end of the ground engaging member 86. An elongated adjustment assembly 90 is pivotally connected to another end of the link 88 and disposed within the vertical constraint 84. The elongated adjustment assembly 90 facilitates a vertical adjustment of the stand system 80 with respect to the golf bag 10.

Figure 5:
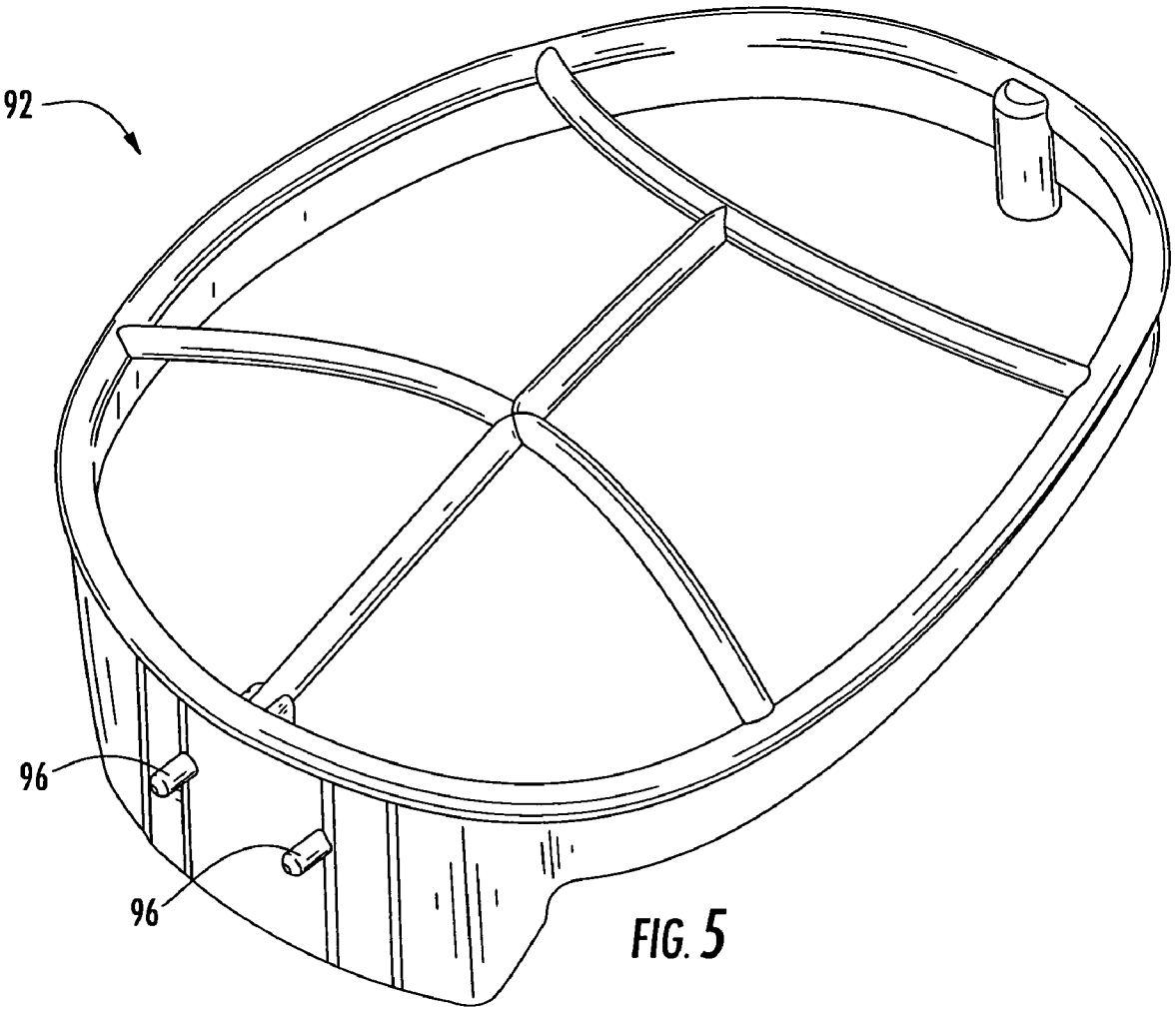
FIG. 5 is a perspective view of a top frame of the stand system of FIG. 4A.
Figure 6:
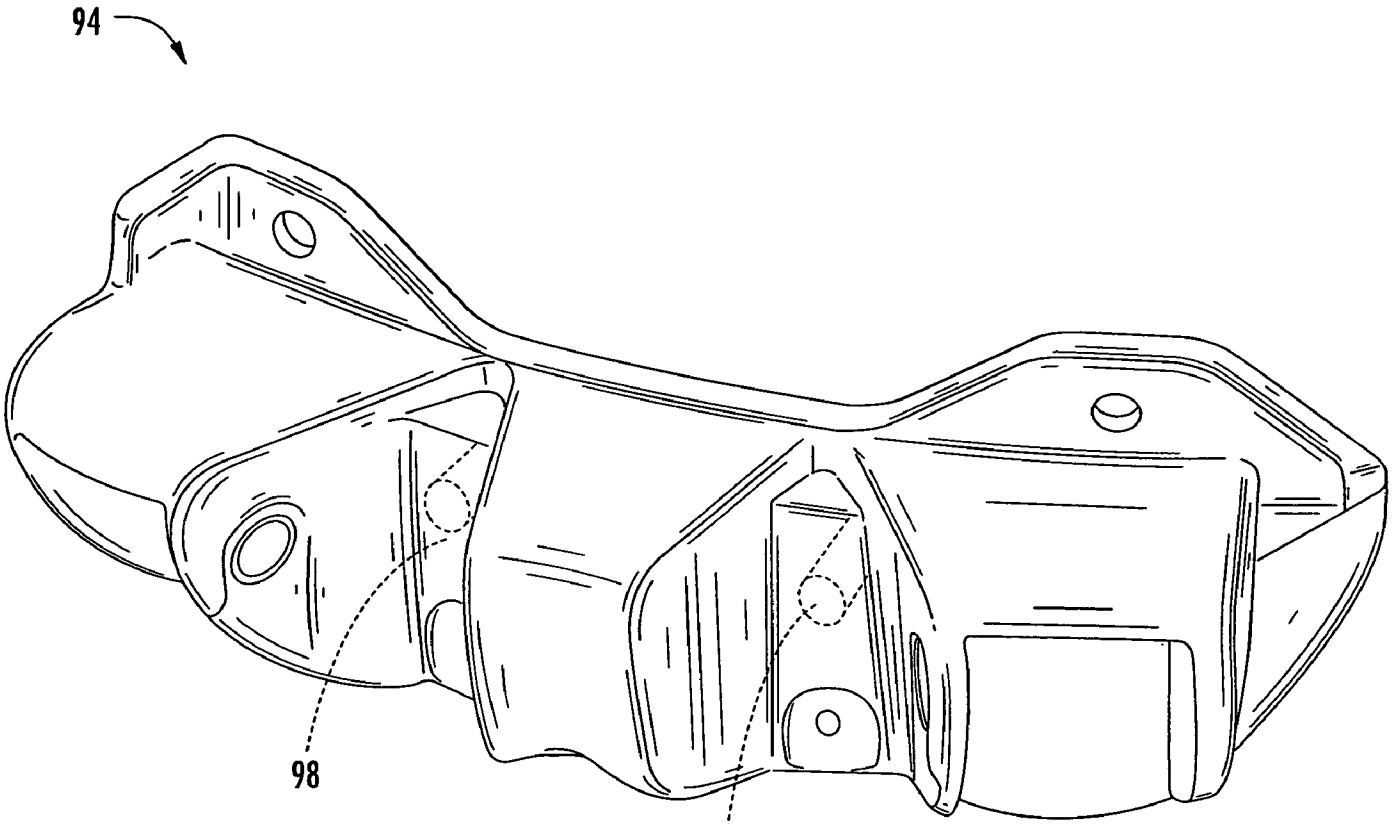
FIG. 6 is a perspective view of a lateral bracket of the stand system of FIG. 4A.

A top frame 92 is attached adjacent the open end 12 of the golf bag 10. A lateral bracket 94 is secured to the top frame 92. As illustrated in FIG. 5, the top frame 92 includes mounting pegs 96. As represented in FIG. 6, the lateral bracket 94 includes corresponding apertures 98 (hidden from view and represented by dashed lines) for receiving the mounting pegs 96 to help ensure proper alignment of the stand system 80 with respect to the golf bag 10. The bracket 94 has a center housing 100 disposed between a pair of clevis devices 102. Each of a pair of elongated cap members 104 is pivotally attached at respective top ends to the clevis devices 102 about a single clevis axis C. Each of the cap members 104 includes a mid-region pivot socket 106.

Each of a pair of pivotal members 108 is attached adjacent the open end 12 of the golf bag 10. More specifically, each of the pivotal members 108 includes a top portion disposed within the cap members 104.

Figure 7:
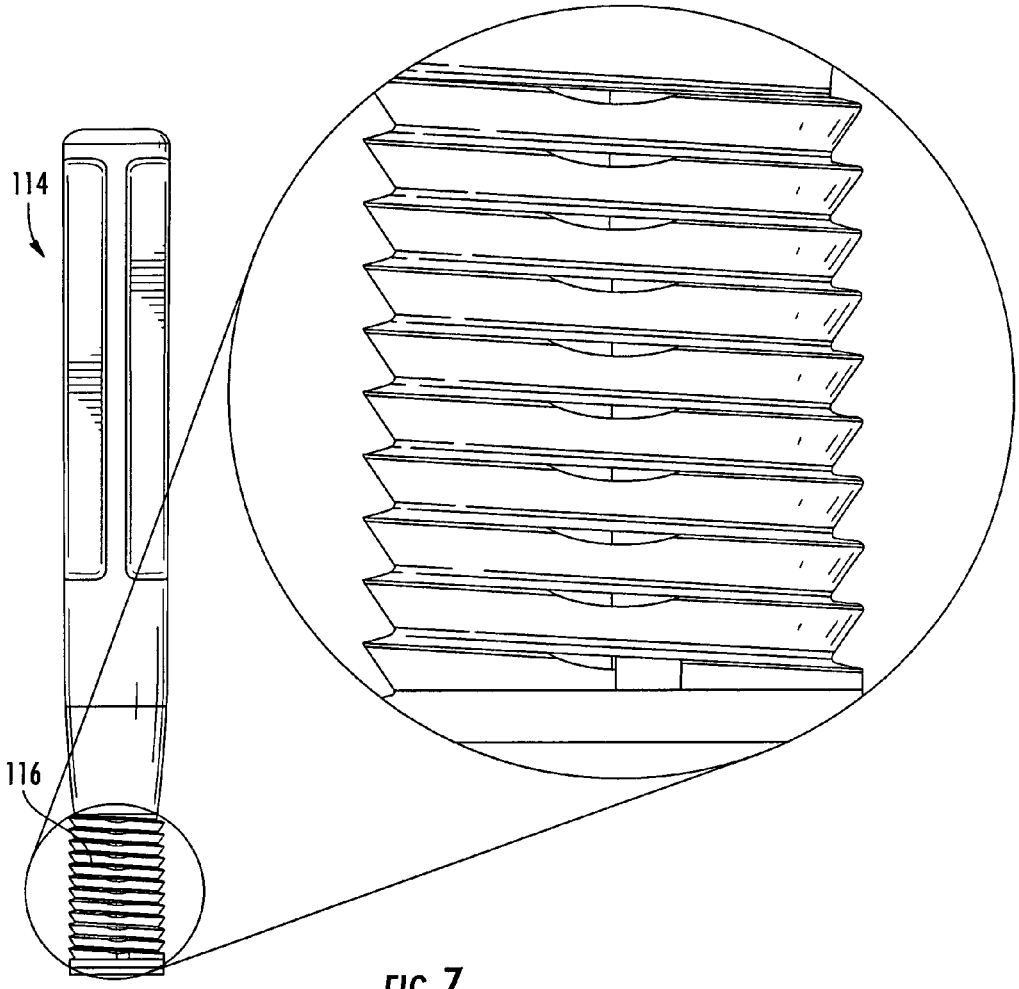
FIG. 7 is a front view of an inner tube guide of the stand system of FIG. 4A.

A center rod assembly 110 is disposed between the pivotal members 108. The center rod assembly 110 includes an outer tube 112 having an upper portion and a lower portion, the outer tube 112 extending along a substantial length of the center rod assembly 110 and the lower portion disposed within the elongated adjustment assembly 90. The center rod assembly 110 further includes an inner tube guide 114. Referring to FIG. 5, the inner tube guide 114 has a top end and a bottom end. The top end is disposed within the housing 100 of the lateral bracket 94 (FIG. 4B) and the bottom end has external threads 116 (FIG. 7). The inner tube guide 114 is longitudinally moveable within the upper portion of the outer tube 112.

Figure 8A:
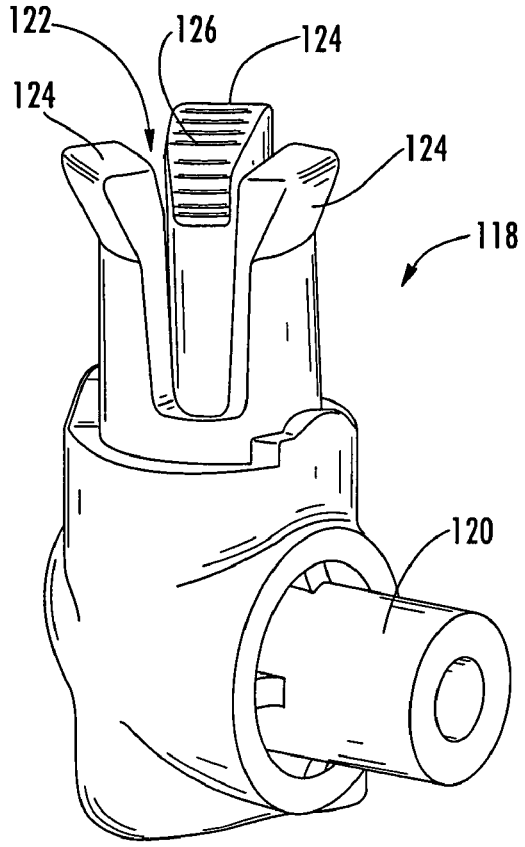
FIG. 8A is a lateral perspective view of a knuckle of the stand system of FIG. 4A.
Figure 8B:
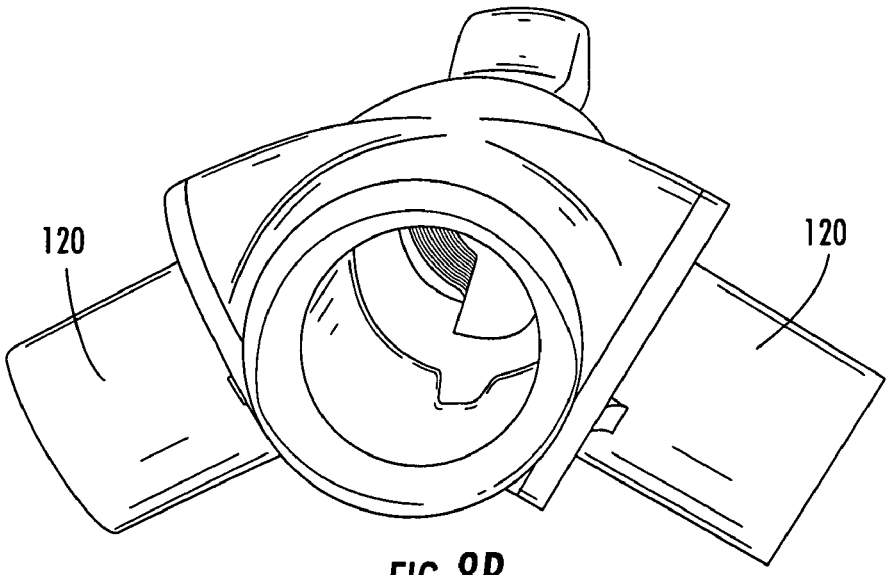
FIG. 8B is a bottom perspective view of the knuckle of FIG. 8A.

A knuckle 118 is secured to the upper portion of the outer tube 112. As illustrated in FIGS. 8A and 8B, the knuckle 118 includes a pair of opposing lateral pivot sockets 120. A top portion of the knuckle 118 has a gripping device 122 having substantially vertical flexible fingers 124. The substantially vertical flexible fingers 124 include internal threads 126 for engagement and disengagement with the external threads 116 of the bottom end of the inner tube guide 114.

Figure 4A:
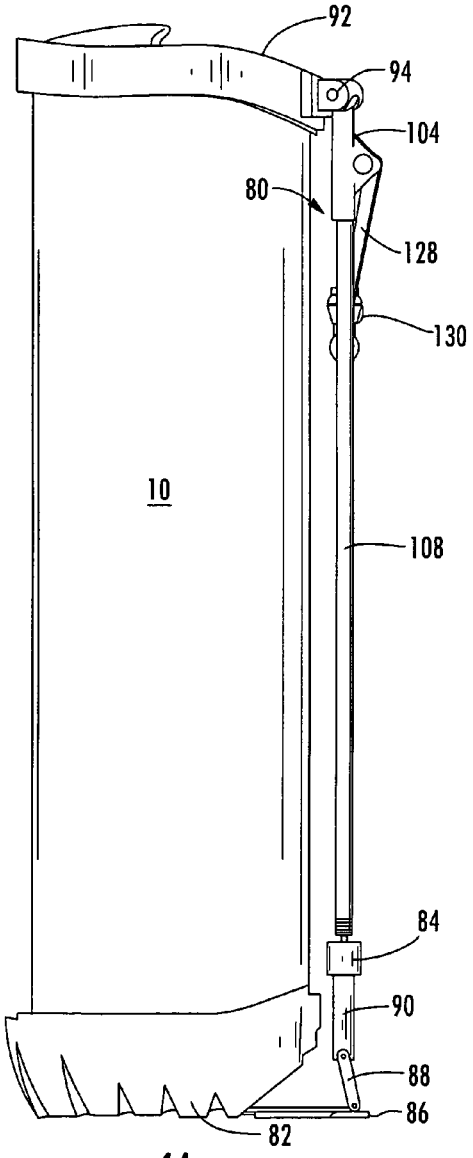
FIG. 4A is a left side view of a stand system for use with a golf bag showing the stand system in a retracted position in accordance with the present invention.
Figure 4B:
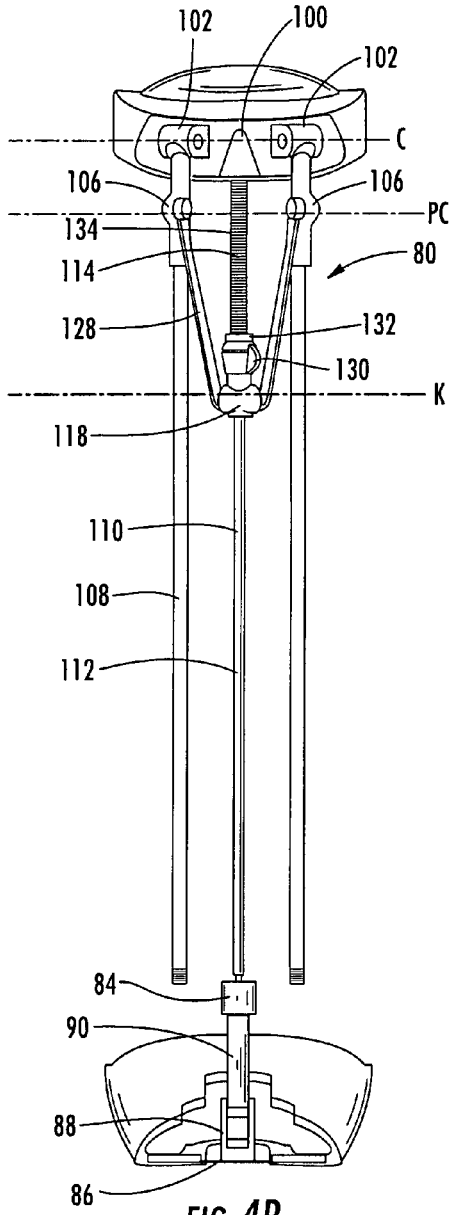
FIG. 4B is a front view of the stand system of FIG. 4A.

Referring to FIGS. 4A and 4B, each of a pair of connecting members 128 is pivotally connected at one end to the mid-region pivot sockets 66 of the cap members 104 about a single pivot cap axis PC. Each of the connecting members 128 is pivotally connected at another end to the opposing lateral pivot sockets 120 of the knuckle 118 about a single knuckle axis K, thereby pivotally linking the center rod assembly 110 to the pivotal members 108.

An annular rotatable locking lever 130 is disposed about the substantially vertical flexible fingers 124 of the gripping device 122 of the knuckle 118. A washer 132 is fully disposed annularly about the inner tube guide 114 (as shown in FIG. 4B) and partially disposed vertically within an upper portion of the locking lever 130 (hidden in FIG. 4B). Rotation of the locking lever 130 in a locked position causes the substantially vertical flexible fingers 124 to squeeze the bottom end of the inner tube guide 114 causing the internal threads 126 of the substantially vertical flexible fingers 124 to engage the external threads 116 of the bottom end of the inner tube guide 114, thereby preventing longitudinal movement of the inner tube guide 114 within the outer tube 112. Rotation of the locking lever 130 in an unlocked position causes the substantially vertical flexible fingers 124 to release the bottom end of the inner tube guide 114 causing the internal threads 126 of the substantially vertical flexible fingers 124 to disengage the external threads 116 of the bottom end of the inner tube guide 114, thereby permitting longitudinal movement of the inner tube guide 114 within the outer tube 112.

A spring 134 is disposed at an upper portion of the center rod assembly 110. The spring 134 is disposed about the inner tube guide 114, the spring 134 having a top end disposed within the center housing 100 of the bracket 94 and a bottom end abutting against a top surface of the washer 132.

In the unlocked position of the locking lever 130, a tilting of the golf bag 10 toward the ground engaging member 86 causes an upward ground force to be exerted upon the ground engaging member 86 and translated through the link 88 resulting in an upward force upon the outer tube 112. In other words, the translation of force through the link 88 translates a radial motion of the ground engaging member 86 to a substantially vertical linear motion of the outer tube 112. The tilting of the golf bag 10 toward the ground engaging member 86 further causes a downward force from the center housing 100 of the lateral bracket 94 which causes the inner tube guide 114 to move longitudinally into the outer tube 112. Such movement causes an upward force from the washer 132 to compress the spring 134, thereby causing the connecting members 128 to pivot in an outward direction away from the golf bag 10, which causes the pivotal members 108 to pivot in an outward direction away from the golf bag 10 to an extended position as illustrated in FIGS. 9A and 9B.

Figure 9A:
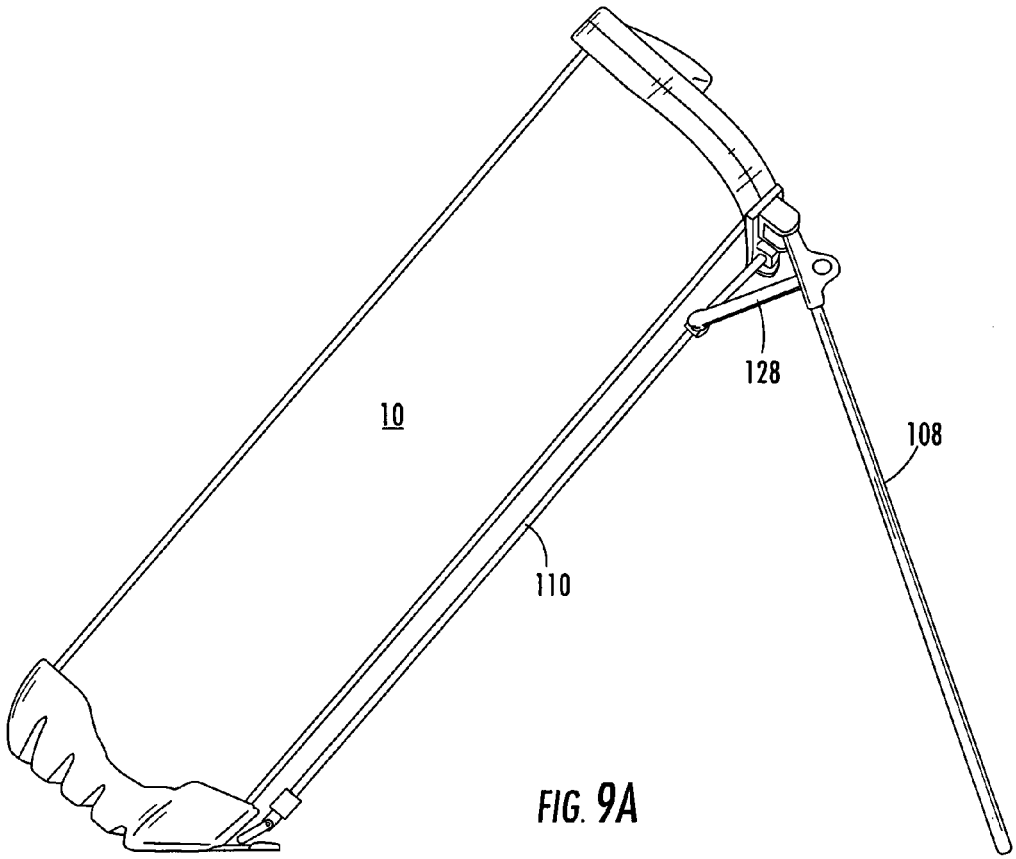
FIG. 9A is a left side view of the stand system of FIG. 4A showing the stand system in an extended position.
Figure 9B:
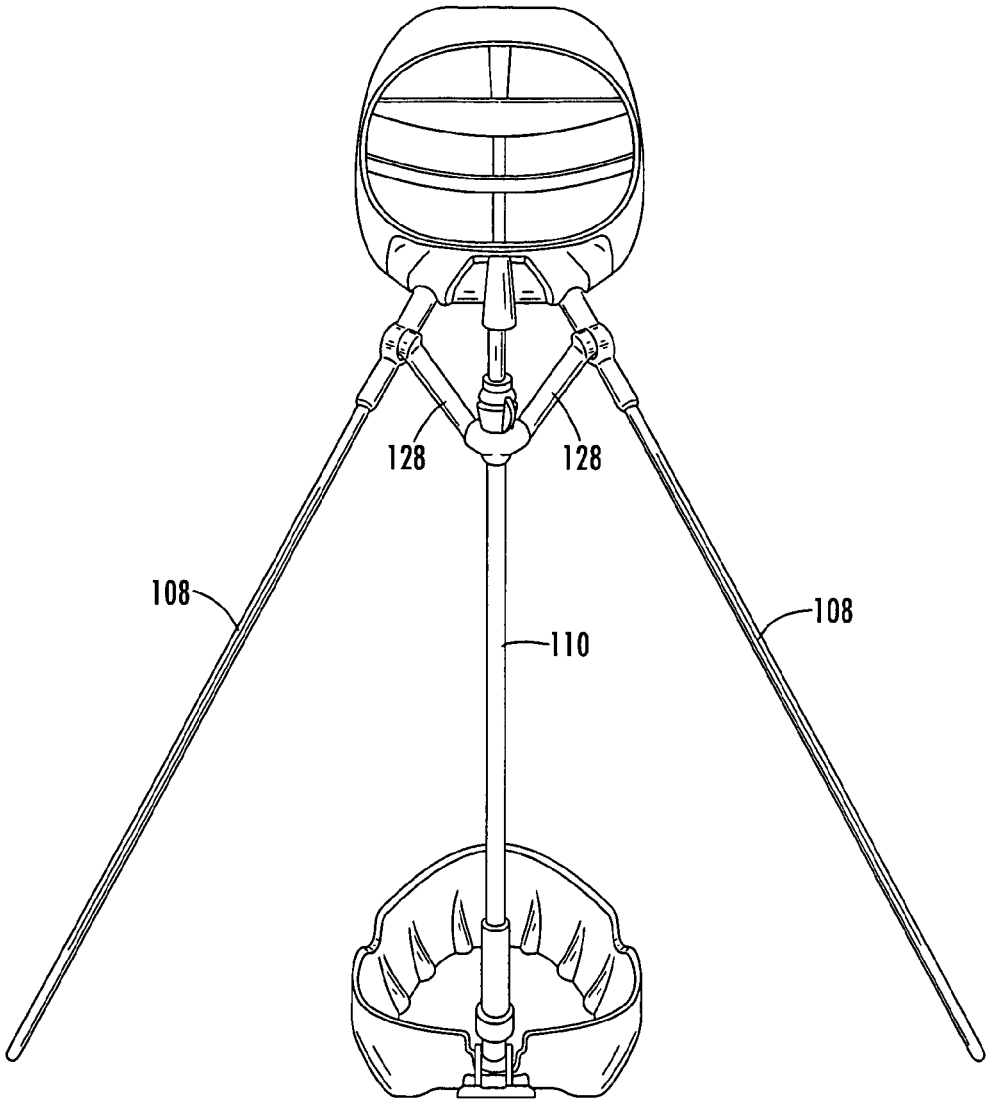
FIG. 9B is a front view of the stand system of FIG. 9A.

A tilting of the golf bag 10 from the extended position shown in FIGS. 9A and 9B away from the ground engaging member 86 causes the upward ground force to be removed from the ground engaging member 86 and the outer tube 112, thereby causing the upward force from the washer 132 to be removed. Such removal of forces permits the spring 134 to expand, causing the inner tube guide 114 to move longitudinally out from the outer tube 112, thereby causing the connecting members 128 to pivot in an inward direction toward the golf bag 10, which causes the pivotal members 108 to pivot in an inward direction toward the golf bag 10 to a retracted position as illustrated in FIGS. 4A and 4B.

Throughout movement of the stand system 80 between the extended position (FIGS. 9A and 9B) and retracted position (FIGS. 4A and 4B), the clevis axis C, the pivot cap axis PC, and the knuckle axis K are parallel with respect to each other. Alternatively, in the event that the clevis axis C, the pivot cap axis PC, and the knuckle axis K are not parallel with respect to each other, a rotational component such as, for example, an orbital socket, may be installed at each joint location of the pivot cap axis PC and the knuckle axis K to facilitate movement along the three non-parallel axes C, PC, K. The above-described configurations of the stand system 80 provide easy and reliable extension and retraction of pivotal members 108. In the event of a component failure, each component of the stand system 80 is replaceable rather than requiring replacement of the entire stand system 80.

The pivotal members 108 and the center rod assembly 110 are machined from aluminum material. The present invention, however, is not limited to such material, as the pivotal members 108 and the center rod assembly 110 may be made from other metals, plastic, composite material, or any other material strong enough to perform the above-described functions.

The connecting members 128 are made from rigid plastic material. The present invention, however, is not limited to such material, as the connecting members 128 may be made from other metal, composite material, or any other material rigid enough to perform the above-described functions.

Figure 10A:
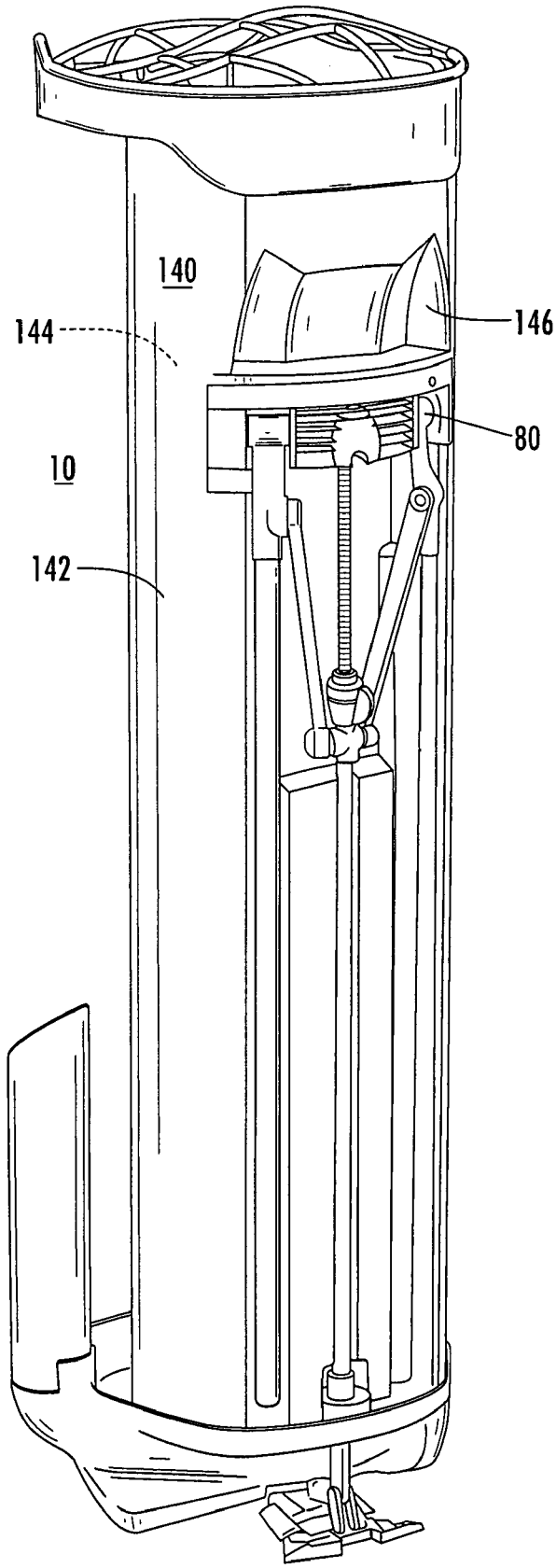
FIG. 10A is a perspective view of a casing for use with a golf bag showing the stand system of FIG. 4A in a retracted position in accordance with the present invention.
Figure 10B:
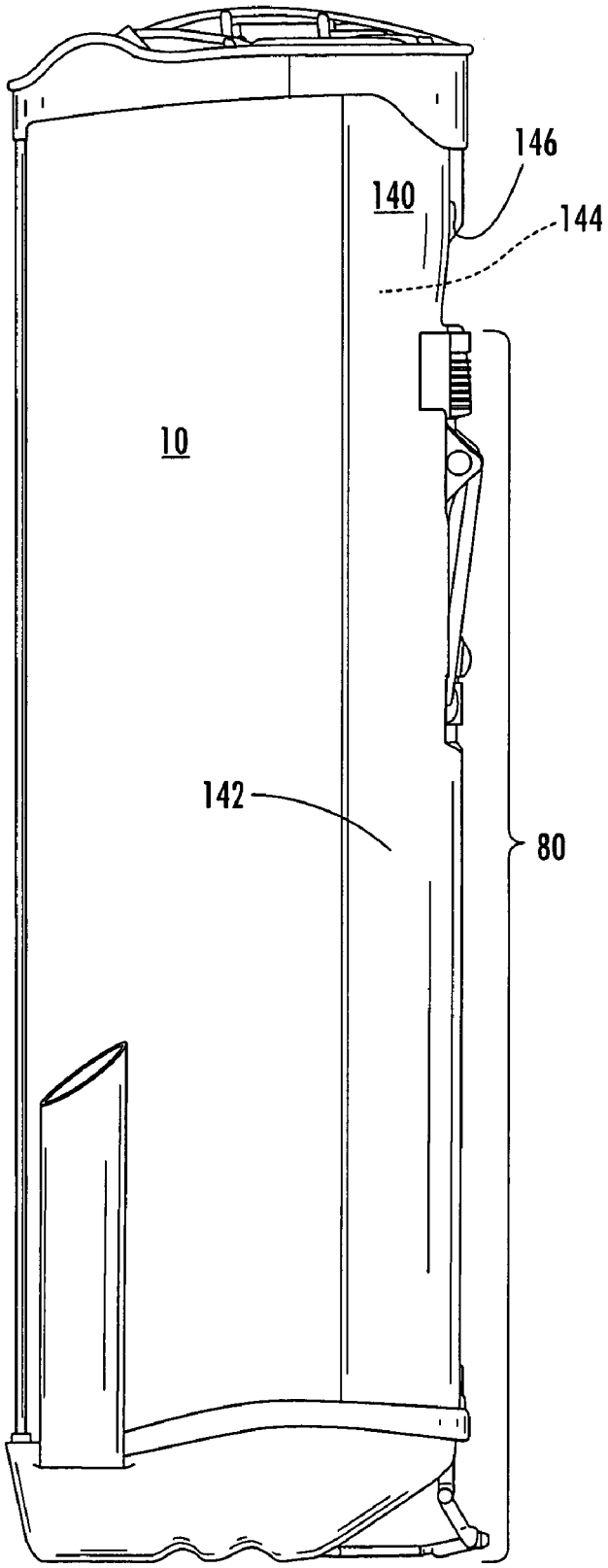
FIG. 10B is a left side view of the casing of FIG. 10A.
Figure 11:
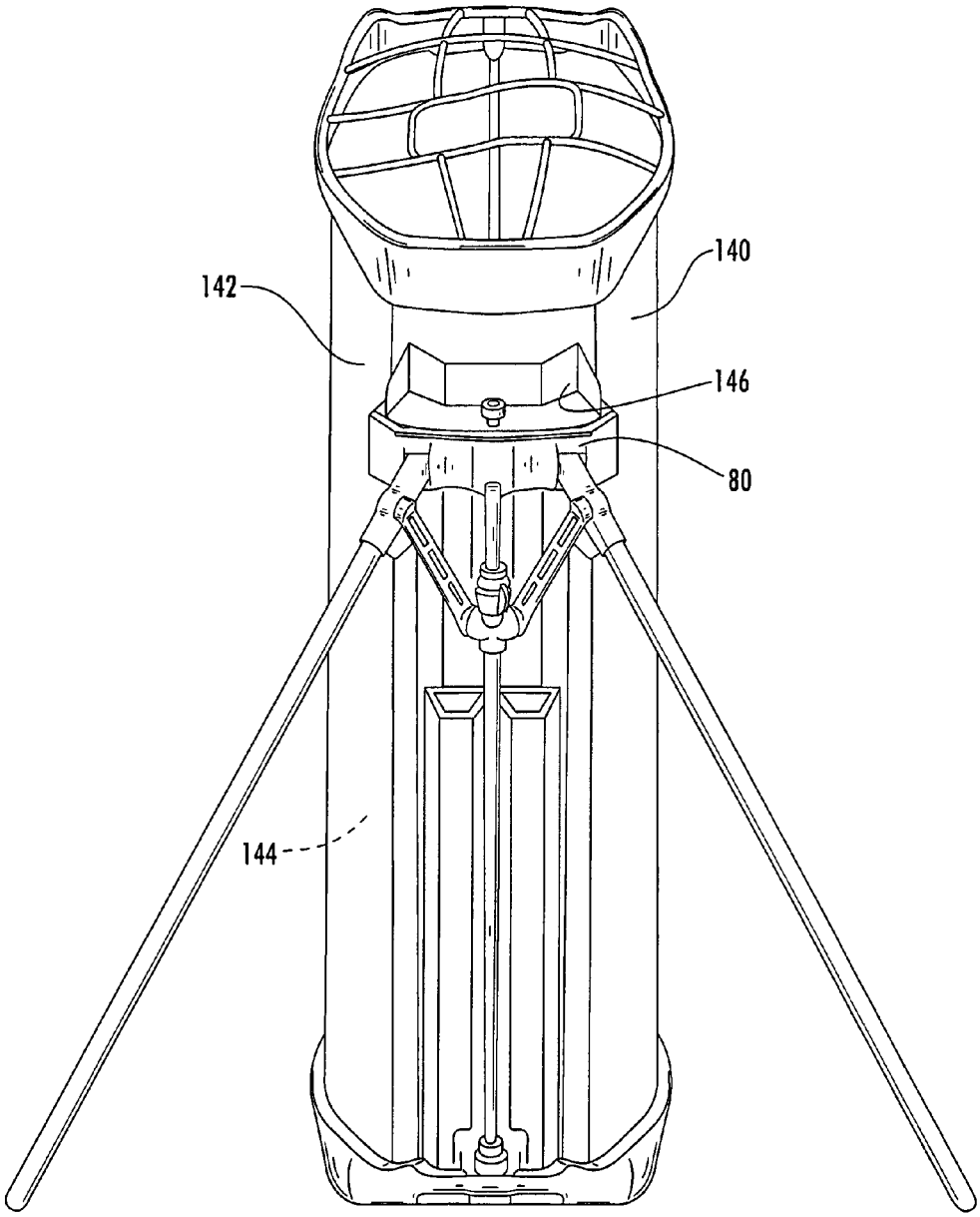
FIG. 11 is a front perspective view of the casing of FIG. 10A showing the stand system in an extended position.

Referring to FIGS. 10A-11, a hybrid cart/stand-style golf bag is illustrated. More specifically, a casing 140 is provided for use with the golf bag 10. The casing 140 includes a shell 142 affixed to an outer surface 144 of the golf bag 10. The shell 142 defines a recess 146 that houses the stand system 80 in a recessed configuration. As illustrated, the shell 142 is integrally formed with the golf bag 10. Alternatively, the shell 142 may be releasable from the golf bag 10.

The configuration and functionality of the stand system 80 of the hybrid cart/stand-style golf bag is virtually identical to those described above with reference to FIGS. 4A-9B. The stand system 80 enables the golf bag 10 to independently stand upright as illustrated in FIG. 11. Additionally, in the retracted position illustrated in FIGS. 10A and 10B, the stand system 80 is housed within the recess 146 of the shell 142 so that it does not interfere with other components in a golf cart.

While the preferred embodiments of the invention have been described in detail above, the invention is not limited to the specific embodiments described which should be considered as merely exemplary. Further modifications and extensions of the present invention may be developed and all such modifications are deemed to be within the scope of the present invention as defined by the appended claims.

What is claimed is:

1. A casing for use with a golf bag, said casing comprising:

a shell affixed to an outer surface of the golf bag, said shell defining a recess in the outer surface of the golf bag, wherein the recess houses a stand system in a recessed configuration, said stand system comprising:

a base member encasing a closed end of the golf bag, the base member comprising a cylindrically-shaped vertical constraint at a top portion of the base member;

a link;

a ground engaging member pivotally attached at one end to a bottom portion of the base member and pivotally connected at another end to one end of the link;

an elongated adjustment assembly pivotally connected to another end of said link and disposed within said vertical constraint;

a pair of pivotal members attached adjacent an open end of the golf bag;

a center rod assembly disposed between said pivotal members, the center rod assembly connected to the ground engaging member by the link;

a pair of connecting members rotatably connected to the center rod assembly and each of the pair of connecting members to a respective pivot member of the pair of pivotal members;

a spring disposed at an upper portion of said center rod assembly; whereby tilting of the golf bag toward said ground engaging member causes an upward ground force to be exerted upon said ground engaging member and translated to an upward force upon said center rod assembly, thereby compressing said spring and causing said pivotal members to pivot in an outward direction away from the golf bag to an extended position, and tilting of the golf bag from said extended position away from said ground engaging member causes the upward ground force to be removed from said ground engaging member and said center rod assembly, thereby permitting said spring to expand and causing said pivotal members to pivot in an inward direction toward the golf bag to a retracted position.

2. The casing of claim 1, wherein said shell is integrally formed with the golf bag.

3. The casing of claim 1, wherein the stand system is mounted in the recess.

4. The casing of claim 1, wherein the outer surface is a surface of a covering of the golf bag.

5. The casing of claim 1, wherein said elongated adjustment assembly facilitates a vertical adjustment of said stand system with respect to the golf bag.

6. The casing of claim 1, wherein said pivotal members comprise aluminum material.

7. The casing of claim 1, wherein said center rod assembly comprises aluminum material.

8. A casing for use with a golf bag, said casing comprising:

a shell affixed to an outer surface of the golf bag, said shell defining a recess in the outer surface of the golf bag, wherein the recess houses a stand system in a recessed configuration, said stand system comprising:

a ground engaging member pivotally attached adjacent a closed end of the golf bag;

a pair of pivotal members attached adjacent an open end of the golf bag;

a center rod assembly disposed between said pivotal members, the center rod assembly connected to the ground engaging member by a link;

a pair of connecting members rotatably connected to the center rod assembly and each of the pair of connecting members to a mid-region pivot socket;

a spring disposed at an upper portion of said center rod assembly; whereby tilting of the golf bag toward said ground engaging member causes an upward ground force to be exerted upon said ground engaging member and translated to an upward force upon said center rod assembly, thereby compressing said spring and causing said pivotal members to pivot in an outward direction away from the golf bag to an extended position, and tilting of the golf bag from said extended position away from said ground engaging member causes the upward ground force to be removed from said ground engaging member and said center rod assembly, thereby permitting said spring to expand and causing said pivotal members to pivot in an inward direction toward the golf bag to a retracted position;

said center rod assembly comprising:

an outer tube comprising an upper portion and a lower portion, said outer tube extending along a substantial length of said center rod assembly and said lower portion disposed within an elongated adjustment assembly; and an inner tube guide comprising a top end and a bottom end, said top end disposed within a housing of a lateral bracket, said bottom end comprising external threads, and said inner tube guide longitudinally moveable within said upper portion of said outer tube.

9. The casing of claim 8, further comprising a knuckle secured to said upper portion of said outer tube, said knuckle comprising: a pair of opposing lateral pivot sockets; and a top portion comprising a gripping device, said gripping device comprising a plurality of substantially vertical flexible fingers comprising internal threads for engagement and disengagement with said external threads of said bottom end of said inner tube guide.

10. The casing of claim 9, wherein said connecting members pivotally connected at one end to said mid-region pivot sockets of cap members about a single pivot cap axis and pivotally connected at another end to said opposing lateral pivot sockets of said knuckle about a single knuckle axis, thereby pivotally linking said center rod assembly to said pivotal members.

11. The casing of claim 10, wherein a clevis axis, said pivot cap axis, and said knuckle axis are parallel with respect to each other.

12. The casing of claim 10, wherein said connecting members comprise rigid plastic material.

13. The casing of claim 10, further comprising an annular rotatable locking lever disposed about said substantially vertical flexible fingers of said gripping device of said knuckle.

14. The casing of claim 13, further comprising a washer fully disposed annularly about said inner tube guide and partially disposed vertically within an upper portion of said locking lever.

15. The casing of claim 14, wherein said spring is disposed about said inner tube guide, said spring comprising a top end disposed within said center housing of said bracket and a bottom end abutting against a top surface of said washer.

16. The casing of claim 15, whereby in said unlocked position of said locking lever, a tilting of the golf bag toward said ground engaging member causes an upward ground force to be exerted upon said ground engaging member and translated through said link resulting in an upward force upon said outer tube, a downward force from said center housing of said lateral bracket causes said inner tube guide to move longitudinally into said outer tube causing an upward force from said washer to compress said spring, thereby causing said connecting members to pivot in an outward direction away from the golf bag causing said pivotal members to pivot in an outward direction away from the golf bag to an extended position, and a tilting of the golf bag from said extended position away from said ground engaging member causes the upward ground force to be removed from said ground engaging member and said outer tube, thereby causing the upward force from said washer to be removed and permitting said spring to expand, causing said inner tube guide to move longitudinally out from said outer tube, thereby causing said connecting members to pivot in an inward direction toward the golf bag causing said pivotal members to pivot in an inward direction toward the golf bag to a retracted position.

17. The casing of claim 16, wherein the translation of force through said link translates a radial motion of said ground engaging member to a substantially vertical linear motion of said outer tube.

18. A casing for use with a golf bag, said casing comprising:

a shell affixed to an outer surface of the golf bag, said shell defining a recess in the outer surface of the golf bag, wherein the recess houses a stand system in a recessed configuration;

a base member encasing the closed end of the golf bag, said base member comprising a cylindrically-shaped vertical constraint at a top portion of said base member;

said stand system comprising:

a ground engaging member pivotally attached adjacent a closed end of the golf bag, wherein said ground engaging member is pivotally attached at one end to a bottom portion of said base member, and said stand system further comprises a link pivotally connected at one end to another end of said ground engaging member;

a pair of pivotal members attached adjacent an open end of the golf bag;

a center rod assembly disposed between said pivotal members;

a spring disposed at an upper portion of said center rod assembly;

an elongated adjustment assembly pivotally connected to another end of said link and disposed within said vertical constraint, whereby tilting of the golf bag toward said ground engaging member causes an upward ground force to be exerted upon said ground engaging member and translated to an upward force upon said center rod assembly, thereby compressing said spring and causing said pivotal members to pivot in an outward direction away from the golf bag to an extended position, and tilting of the golf bag from said extended position away from said ground engaging member causes the upward ground force to be removed from said ground engaging member and said center rod assembly, thereby permitting said spring to expand and causing said pivotal members to pivot in an inward direction toward the golf bag to a retracted position.

19. A casing for use with a golf bag, said casing comprising:

a shell affixed to an outer surface of the golf bag, said shell defining a recess in the outer surface of the golf bag, wherein the recess houses a stand system in a recessed configuration, said stand system comprising:

a ground engaging member pivotally attached adjacent a closed end of the golf bag;

a pair of pivotal members attached adjacent an open end of the golf bag;

a center rod assembly disposed between said pivotal members;

a spring disposed at an upper portion of said center rod assembly; and an outer tube comprising an upper portion and a lower portion, said outer tube extending along a substantial length of said center rod assembly and said lower portion disposed within an elongated adjustment assembly; and an inner tube guide comprising a top end and a bottom end, said top end disposed within a housing of a lateral bracket, said bottom end comprising external threads, and said inner tube guide longitudinally moveable within said upper portion of said outer tube, whereby tilting of the golf bag toward said ground engaging member causes an upward ground force to be exerted upon said ground engaging member and translated to an upward force upon said center rod assembly, thereby compressing said spring and causing said pivotal members to pivot in an outward direction away from the golf bag to an extended position, and tilting of the golf bag from said extended position away from said ground engaging member causes the upward ground force to be removed from said ground engaging member and said center rod assembly, thereby permitting said spring to expand and causing said pivotal members to pivot in an inward direction toward the golf bag to a retracted position.

* * * * *